US005850742A

United States Patent [19]

Bang et al.

[11] Patent Number: 5,850,742

[45] Date of Patent: Dec. 22, 1998

[54] APPARATUS AND METHOD OF CONTROLLING AUTOMATIC DOOR OF AIR CONDITIONER

[75] Inventors: Yong-Woong Bang; Je-Myoung Moon, both of Kyungki-do, Rep. of Korea

[73] Assignee: Smasung Electronics Co., Ltd., Suwon-City, Rep. of Korea

[21] Appl. No.: 911,144

[22] Filed: Aug. 14, 1997

[30] Foreign Application Priority Data

Sep. 12, 1996 [KR] Rep. of Korea ..... 1996-39522

[51] Int. Cl.[6] ..... F25D 17/06

[52] U.S. Cl. ..... 62/89; 62/161; 62/263; 251/129.03; 454/233; 454/315; 454/325

[58] Field of Search ..... 62/262, 263, 89, 62/161; 251/129.03; 454/233, 313, 315, 319, 321, 325, 335

[56] References Cited

U.S. PATENT DOCUMENTS 4,848,214 7/1989 Nagao et al. ..... 98/31.6

5,443,420 8/1995 Kim et al. ..... 454/256

5,461,875 10/1995 Lee et al. ..... 62/89

5,746,655 5/1998 Lee ..... 454/233

*Primary Examiner*—William E. Tapolcai

*Attorney, Agent, or Firm*—Burns, Doane, Swecker & Mathis, L.L.P.

[57] ABSTRACT

An air conditioner includes an inlet for receiving room air, a heat exchanger for heating or cooling the air, an outlet for discharging the heated or cooled air back into the room, a fan for circulating the air through the air conditioner, inlet and outlet doors for opening/closing the inlet and outlet, a motor for driving the doors, and a controller for automatically actuating the motor to open the doors when the air conditioner is activated, and close the doors when the air conditioner is deactivated. A control by-pass is provided in a remote controller which is relatively inaccessible to a normal user but which can be actuated by an air conditioner tester or shipper for maintaining the doors open even when the air conditioner is deactivated (e.g., during testing or shipping) to prevent the doors from being damaged.

8 Claims, 7 Drawing Sheets

APPARATUS AND METHOD OF CONTROLLING AUTOMATIC DOOR OF AIR CONDITIONER

BACKGROUND OF THE INVENTION

1. Field of the Invention

The present invention relates to an apparatus and a method of controlling an automatic door of an air conditioner.

An automatic door is an opening/closing means mounted on an inlet and an outlet of an air conditioner. Namely, it is the means automatically opening/closing the inlet and outlet according to the operation of the air conditioner. Hereinafter, an automatic door mounted on the inlet is called an inlet opening/closing means, and the other automatic door mounted on the outlet is called an outlet opening/closing means. That is, the automatic doors are commonly called the inlet and outlet opening/closing means.

2. Discussion of Related Art

In general, a conventional air conditioner, as shown in FIGS. 1 and 2, includes: an inlet 3 formed on the lower part of a main body 1, and intaking the indoor air; an outlet 7 formed on the front upper part of the main body 1 and discharging air heat exchanged through a heat exchanger indoors; a plate element 15 fixed on the front surface of the main body 1 to decorate the appearance of the main body 1 and protect the internal components; and a control panel 17 formed on a predetermined portion of the plate element 15 and for selecting an operation mode such as automatic, cooling, dehumidifying, wind blowing or heating, for operating the air conditioner, stopping its operation, and controlling the amount and direction of the air discharged through the outlet 7. In the control panel 17, there is disposed a remote controller signal receiver for receiving a remote control signal transmitted from a remote controller.

Inside the main body 1, there is disposed a heat exchanger 37 for heat-exchanging the indoor air intaken through the intake 3 by the evaporating latent heat of coolants. An indoor fan 41 disposed above the heat exchanger 37 draws the indoor air through the heat-exchanger 37 and then discharges the air through the outlet 7. A duct element surrounds the indoor fan 41 and guides the heat-exchanged air toward the outlet 7.

Meanwhile, at the inlet 3, there is disposed an inlet opening/closing means 30 for opening the inlet 3 to intake the indoor air during the operation of the air conditioner, and preventing dust and other alien substances from flowing into the main body 1 during the stand-by state of the air conditioner as well as closing the inlet 3, causing the air conditioner to have a good appearance. At the outlet 7, there is disposed an outlet opening/closing means 12 for opening the outlet 7 to discharge the heat exchanged air indoors during the operating mode, and preventing dust and other alien substances from flowing into the main body 1 during the stand-by state of the air conditioner as well as closing the outlet 3, causing the air conditioner to have a good appearance.

Moreover, in the outlet 7, there are mounted up and down wind blades 9 for adjusting the direction of the heat-exchanged air discharged indoors upwards and downwards, and right and left wind blades 11 arranged perpendicular to the up and down wind adjust blades and controlling the direction of the air discharged indoors right and left.

Here, the inlet opening/closing means 30, as illustrated in FIG. 2, includes a pinion 32 forwardly or reversely rotated by an inlet motor 31; a sliding element 33 meshing with a side of the pinion 32 and vertically moving according to the forward/reverse rotation of the pinion 32; inlet grills 34 rotating according to the vertical movement of the sliding element to open/close the inlet 3; and a guiding element 35 mounted on both sides of the inlet 3 to support the inlet grills 34, allowing the rotation of the grills 34 and to guide the opening/closing of the inlet grills 34.

More particularly, as illustrated in FIG. 3, on both sides of each inlet grill 34, there are mounted a hinge axle 34*a* mounted in a fixing groove 35*a* formed on the guiding element 35 and rotatably supporting the inlet grill 34; a protrusion part 34*b* extending into a slot 33*a* formed on the sliding element 33 and into a circular arc shaped guiding groove 35*b* formed on the guiding element; and a gear part 33*b* formed on one side of the sliding element and meshing with the pinion 32.

Meanwhile, the outlet opening/closing means 12, as illustrated in FIG. 2 and FIG. 4, includes an outlet door 13, a supporting element 19 fixed to a front upper part of the main body 1; an outlet motor 21 fixed to the supporting element and generating energy for moving the outlet door 13 upwards and downwards; a pinion 23 joined with the axle 22 of an outlet motor 21; and a rack 25 fitting against the pinion 23 and converting the rotating movement of the pinion into rectilinear movement to thereby vertically move the outlet door 13.

On the inner upper part of the main body 1, there is mounted a louver motor 27 for driving the up and down wind blades 9 and the right and left wind blades 11. The up and down wind blades 9 and the right and left wind blades 11 are joined through the multitude of link elements 29 driven by the louver motor 27.

Referring to FIGS. 1 to 4, described below is an operation of the thus-structured conventional air conditioner.

Firstly, if a user selects an intended operation mode through the remote controller or the control panel 17, the inlet motor 31 is driven and the pinion 32 rotates. By the rotation of the pinion 32, the gearing part 33*b* moves upwardly, and this makes the sliding elements 33 and the slots 33*a* move upwards. According to the ascending movement of the slot 33*a*, the protrusion part 34*b* of the inlet grills 34 rotate under the guidance of the circular arc shaped guiding grooves 35*b*, so that each of the inlet grills 34 rotates at a predetermined angle to open the inlet 3.

At the same time, the outlet motor 21 is driven and rotates the pinion 23. By the rotation of the pinion 23, the rack 25 descends. The outlet door 13 coupled with the rack 25 accordingly descends and the outlet 7 is opened.

Meanwhile, if the control system determines that the inlet 3 and the outlet 7 are completely opened, it generates a control signal for stopping the inlet and outlet motors 31 and 21. By that control signal, both the motors 31 and 21 stop their operations.

Thereafter, the control system generates a control signal for driving the air conditioner, and a condenser motor is driven by the control signal to circulate coolants.

After a predetermined time, an indoor fan motor 39 is driven by the control signal of the control system. And the indoor fan 41 rotates in accordance with the indoor fan motor 39 to intake the indoor air through the inlet 3. The air is heat-exchanged in the heat-exchanger and discharged indoors through the outlet 7. Here, the louver motor 27 is driven by the control signal which is variable according to a normal wind direction. The up and down wind blades 9 and the right and left wind blades 11 mesh with the louver motor 27, so that the direction of the air discharge through the outlet 7 is controlled in every direction.

If a stop key is pushed, a signal is supplied to the control system from the part through the operation part control panel 17, the operations of the condenser motor and the indoor fan motor 39 stop, and accordingly the air conditioner stops. By the control signal, the louver motor 27 stops so that the operations of the up and down wind blades 9 and the right and left wind blades 11 stop finally.

By the control signal, the inlet motor 31 is driven reversely and the pinion 32 rotates. By the reverse rotation of the pinion 32, the gear part 33*b* moves downwards and the sliding element 33 descends. Accordingly, the slots 33*a* descend, and the parts 34*b* of the inlet grill 34 rotate reversely under the guidance of the circular shaped guiding grooves 35*b*, so that the inlet grills 34 rotate and the inlet 3 is closed.

At the same time, the outlet motor 21 is reversely driven by the control signal, and the rack 25 ascends, so that the outlet door 13 coupled with the rack 25 vertically moves, closing the outlet 7.

As described above, the inlet 3 and the outlet 7 are opened during use of the air conditioner, and they are closed during non-use of the air conditioner, so that dust or other harmful substances cannot enter the main body 1 of the air conditioner.

But, the conventional air conditioner has a problem in that if the inlet 3 or the outlet 7 of the air conditioner gets damaged by the fault of the quality control examiner during the function test in the manufacturing procedures, or by external shock during the transportation of the air conditioner, it may not be able to perform properly or present a nice appearance.

SUMMARY OF THE INVENTION

Accordingly, the present invention is directed to a method and an apparatus for controlling an automatic door of an air conditioner that substantially obviates one or more of the above-noted problems.

An object of the present invention is to provide a method and an apparatus for controlling an automatic door of an air conditioner to prevent damage to an inlet and an outlet during a testing or transportation of the air conditioner, by maintaining the inlet and the outlet opened even though the air conditioner is deactivated.

Additional features and advantages of the invention will be set forth in the description which follows, and in part will be apparent from the description or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus of controlling an automatic door of an air conditioner which heat-exchanges indoor air through an indoor heat exchanger by driving a condenser motor, an indoor fan motor and a louver motor according to an operation mode set by a user and then discharges the air indoors through an outlet, includes:

means for manually keying-in an input for stopping the operation of the air conditioner with the automatic door opened regardless of the operation of the air conditioner, a control part for stopping the air conditioner with the automatic door opened by the opening key input; and automatic door opening/closing means for opening/closing the automatic door of the air conditioner by the control signal.

To accomplish the above-mentioned object, provided is a method of controlling an automatic door of an air conditioner which heat-exchanges indoor air through an indoor heat exchanger by driving a condenser motor, an indoor fan motor and a louver motor according to an operation mode set by a user and then discharges the air indoors through an outlet, including the steps of: checking an input has been manually keyed-in for stopping the air conditioner with the door remaining open; and stopping the air conditioner with the automatic door opened if such input has been keyed-in.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENTS

Reference will now be made in detail to the preferred embodiments of the present invention, which are illustrated in the accompanying drawings.

Figure 1:
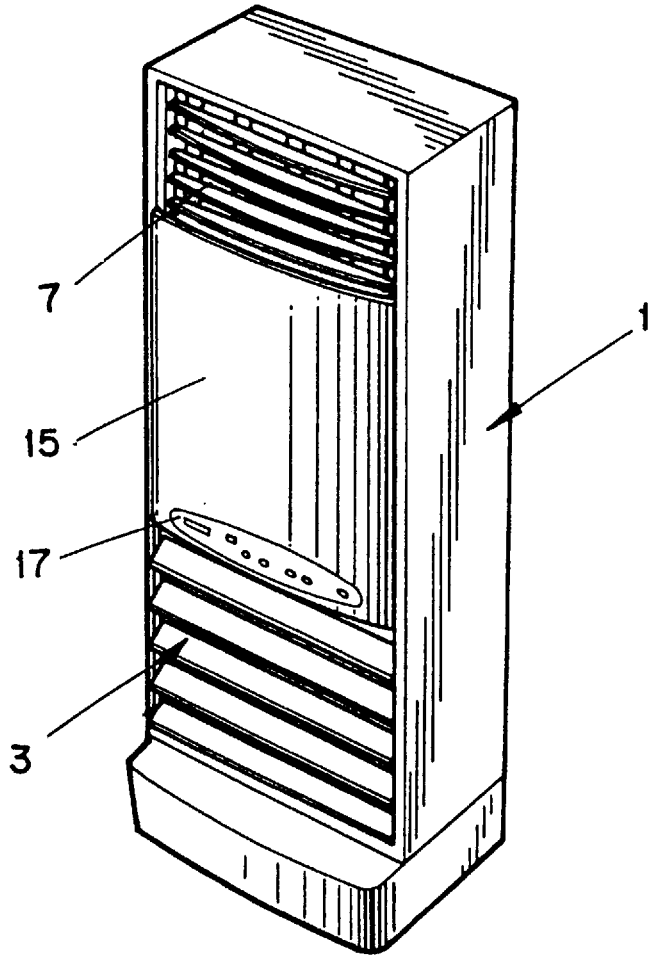
FIG. 1 (PRIOR ART)
FIG. 1 is a schematic perspective view illustrating a prior art air conditioner.
Figure 2:
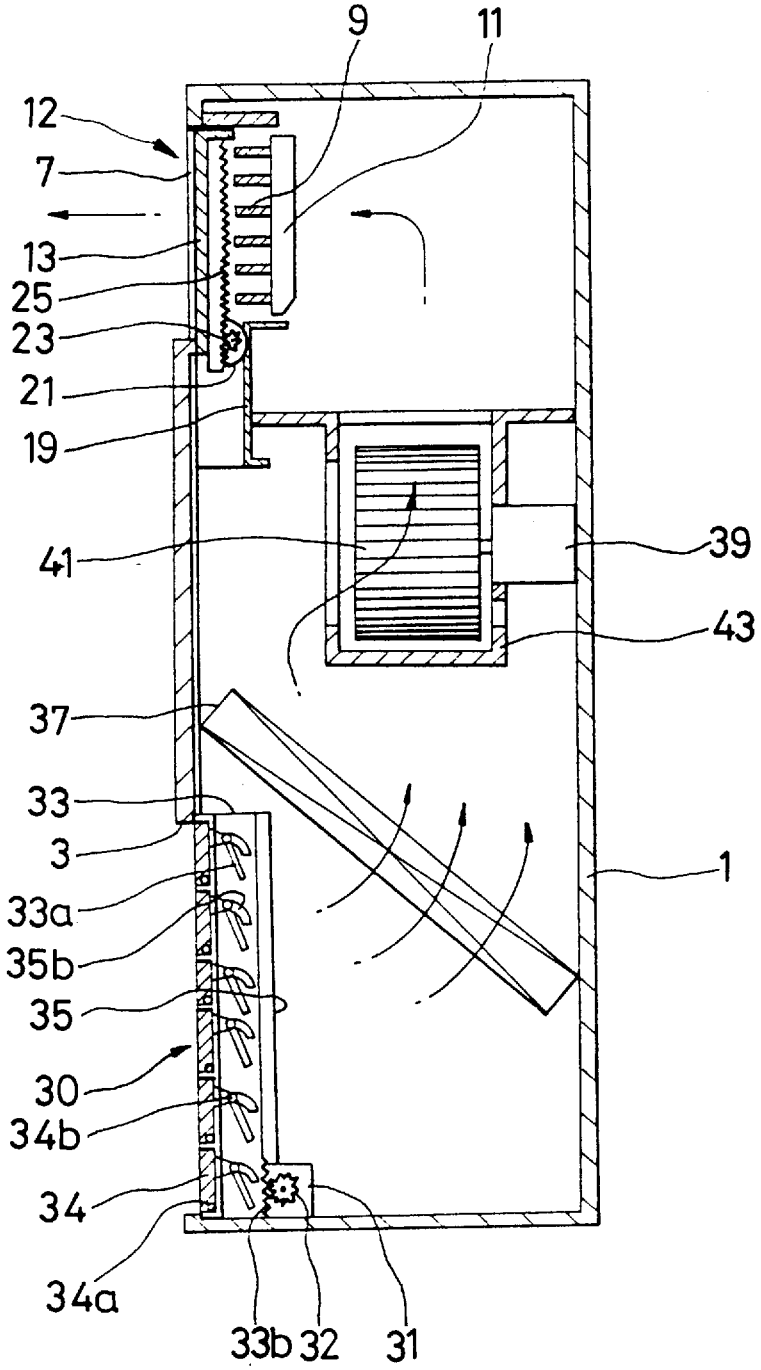
FIG. 2 (PRIOR ART)
FIG. 2 is a longitudinal sectional view illustrating the internal structure of the prior art air conditioner.
Figure 3:
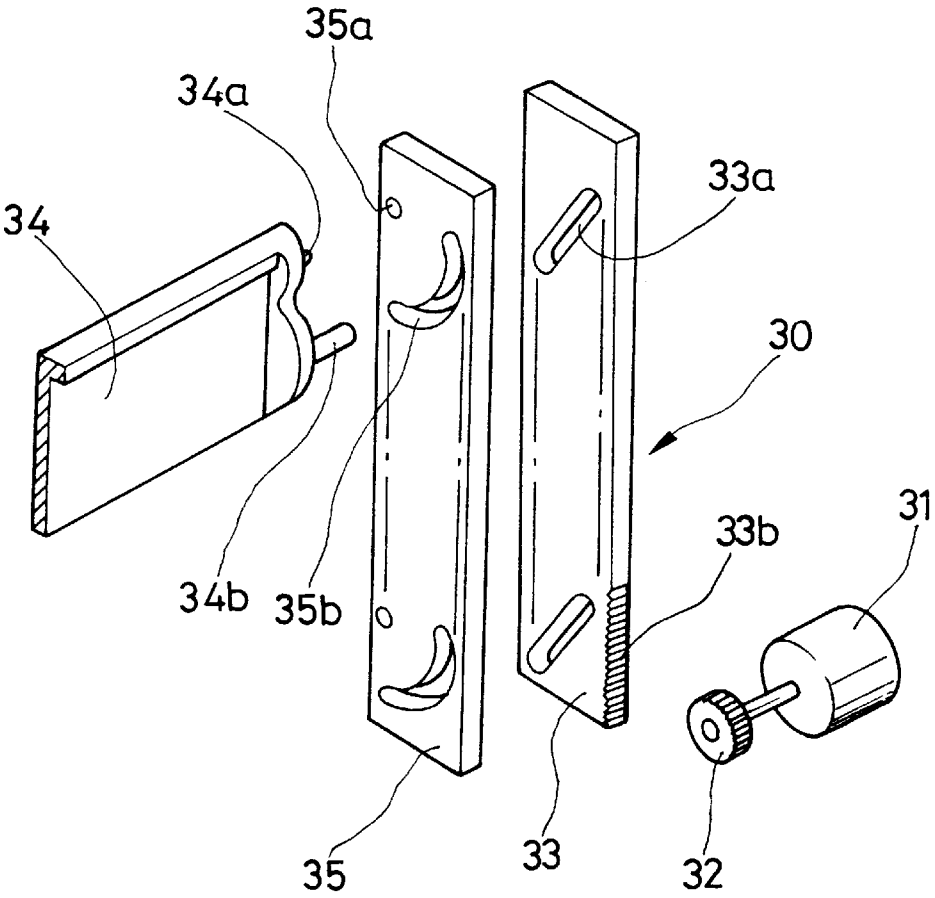
FIG. 3 (PRIOR ART)
FIG. 3 is an exploded perspective view of a conventional inlet opening/closing means of FIG. 2.
Figure 4:
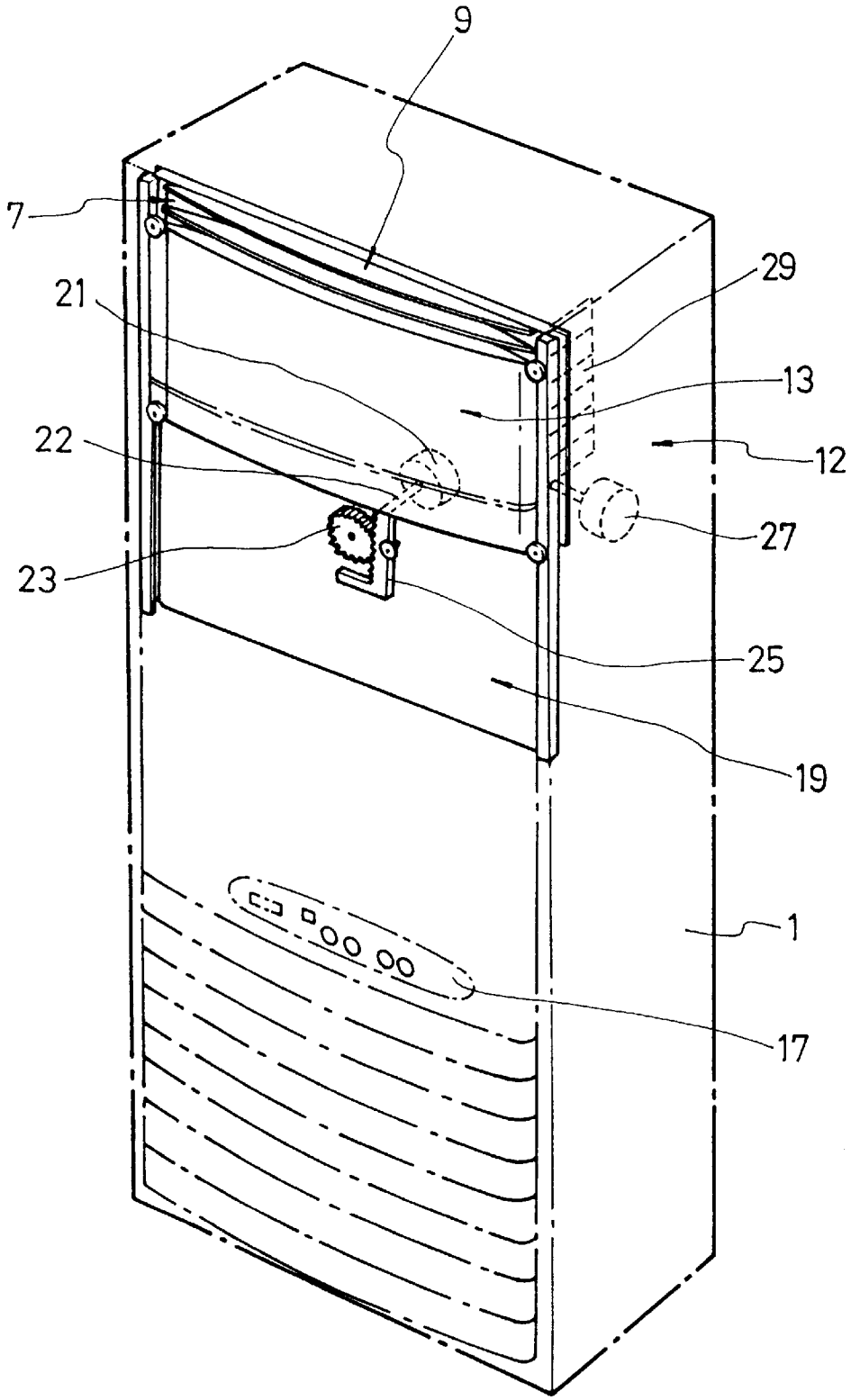
FIG. 4 (PRIOR ART)
FIG. 4 is a perspective view illustrating the operational procedures of an outlet opening/closing means of FIG. 2.
Figure 5:
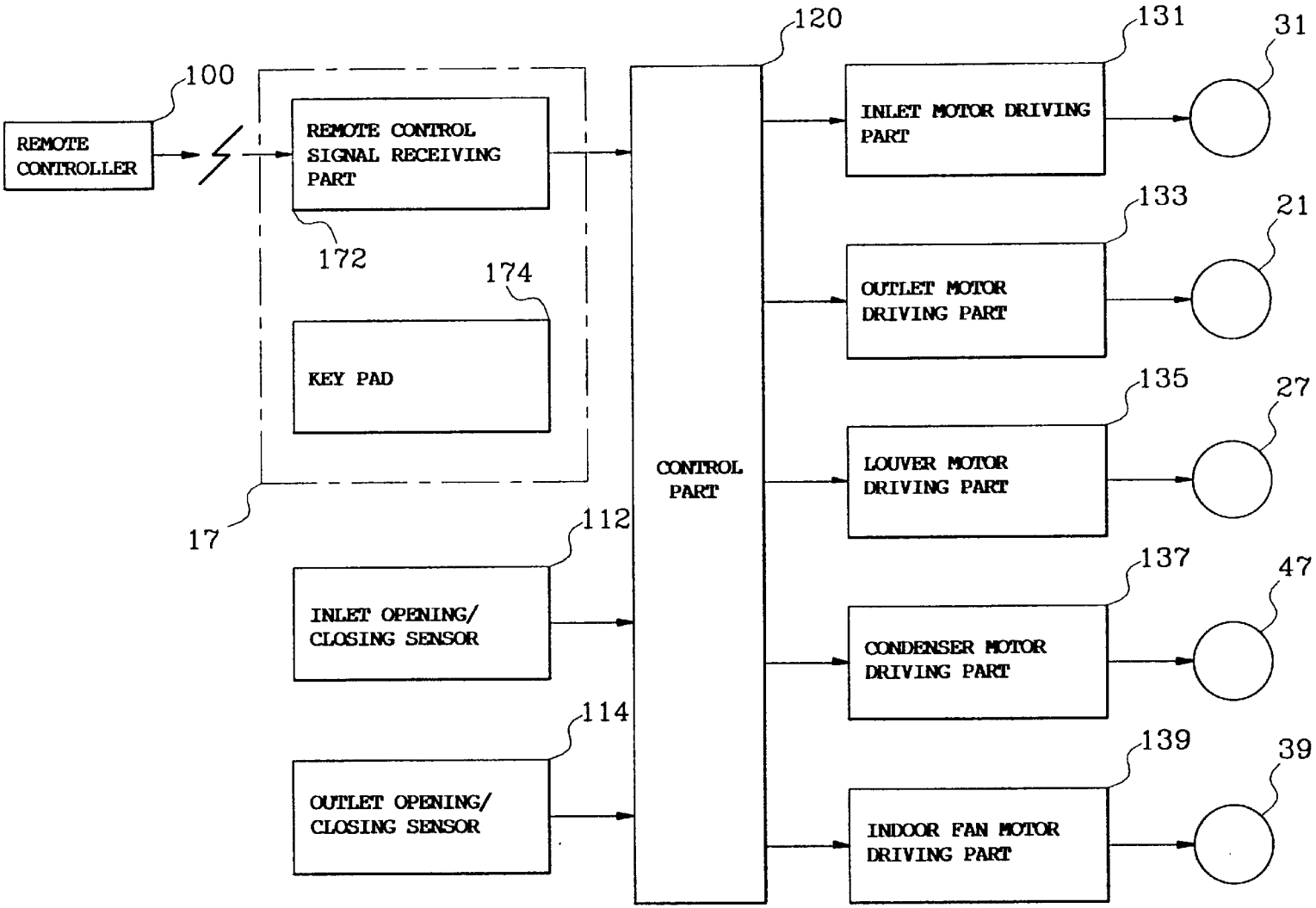
FIG. 5 is a schematic block diagram illustrating an automatic door controlling means of an air conditioner of the invention.

As illustrated in FIG. 5, an automatic door controlling device of the invention includes a control panel 17, an inlet opening/closing sensor 112, an outlet opening/closing sensor 114, a control system 120, an inlet motor driving part 131, an outlet motor driving part 133, a louver motor driving part 135, a condenser motor driving part 137 and an indoor fan motor driving part 139.

Figure 7A:
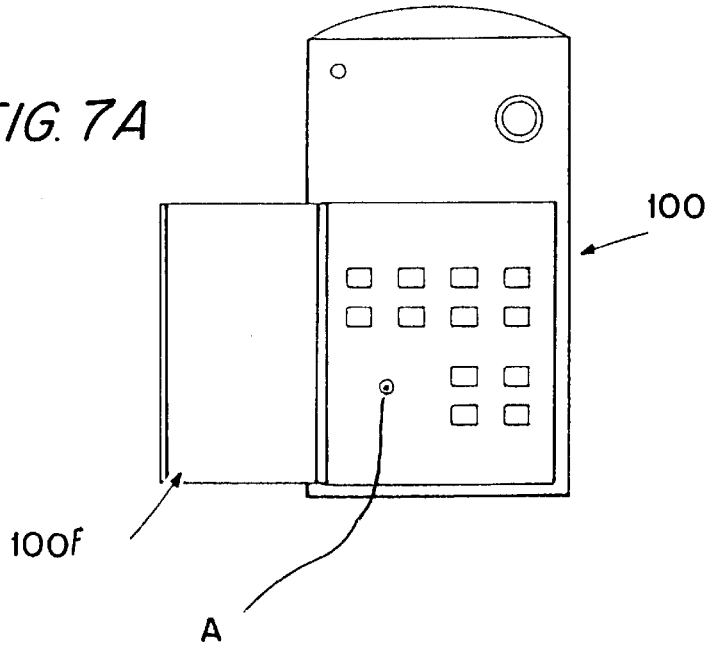
FIGS. 7A and 7B depict alternative locations for a control by-pass in a remote controller.
Figure 7B:
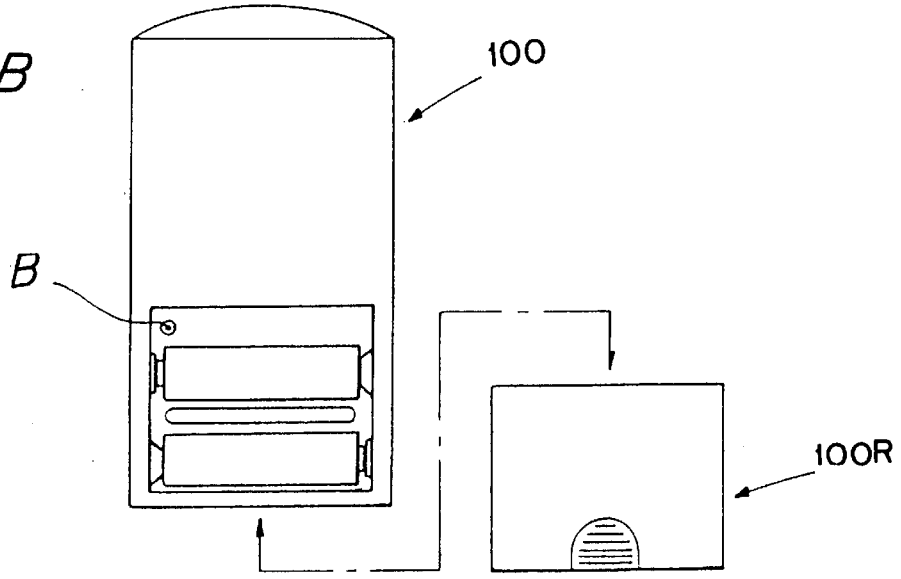

In FIG. 5, the control panel 17 includes a remote control signal receiving part 172 for receiving a remote control signal transmitted from a remote controller 100; and a key pad 174 for setting the operation mode, the wind amount, the wind direction, the desired temperature, and having a driver key for operating or stopping the air conditioner. When a key is pressed by a user a signal is sent to the control system 120. Here, behind a front cover A of the remote controller 100 shown in FIG. 7A, or behind a battery cover of a back surface of the remote controller 100 as illustrated in FIG. 7B, there is a key opening A or B formed in a hole which is incapable of manual operation by a normal user. This key should be operated by only the tester or manager, as a control by-pass to stop the operation of the air conditioner with the automatic inlet and the outlet doors remaining opened.

The inlet opening/closing sensor 112 senses if the inlet 3 is opened or closed, and applies the result to the control part 120. The outlet opening/closing sensor 114 senses if the outlet 7 is opened or closed, and applies it to the control part 120. The control part 120 opens the inlet 13 and the outlet 7 by an operation key signal from the operation part 17, generates a control signal for driving the condenser motor driving part 137, and generates a control signal for driving the indoor fan motor driving part 139 and the louver motor driving part 135 according to the wind amount and direction fixed by the user.

The control part 120 closes the inlet 3 and the outlet 7 by the operation stop key signal from the operation part 120, generates a control signal for stopping the condenser motor driving part 137, the indoor motor driving part 139 and the louver motor driving part 135 with the inlet 3 and the outlet 7 opened when the opening key signal is input thereto from the remote controller 100 through the remote control signal receiving part 172 by the operation of the tester or manager.

In FIG. 5, the inlet motor driving part 131 opens/closes the inlet 3 by driving the inlet motor 31 with the control signal from the control part 120. The outlet motor driving part 133 opens/closes the outlet 7 by driving the outlet motor 21 with the control signal of the control part 120. The louver motor driving part 135 drives the up/down and right/left wind blades 9 and 11 by the control signal. The condenser motor driving part 137 circulates coolants by driving the condenser motor 47 with the control signal to perform the air conditioning. The indoor fan motor driving part 139 drives the indoor fan 39 by the control signal to intake the indoor air, and blasts the air heat-exchanged in the heat-exchanger to the outlet 7.

Figure 6:
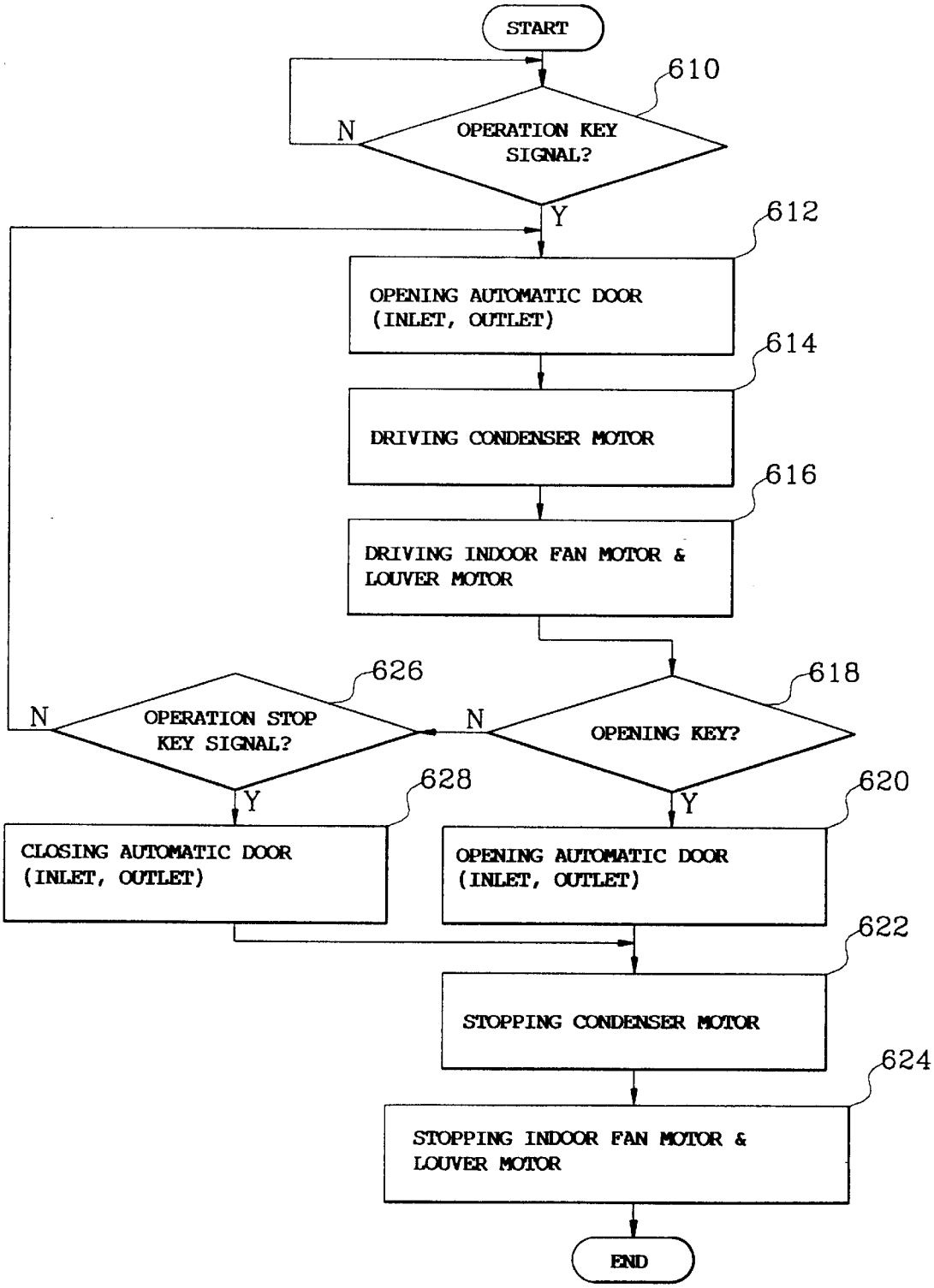
FIG. 6 is a flowchart illustrating the operational procedures of controlling the automatic door of the air conditioner of the invention.

Referring to FIGS. 5 to 7, described are procedures of controlling the automatic door of the air conditioner.

Firstly, if a user selects an intended operation mode through the remote controller or the operation part 17 in step 610, the control part 120 generates the control signal for opening the inlet 3 and the outlet 7 by the operation key signal from the operation part 17. The inlet motor 31 is driven by the control signal of the control part 120 and the pinion 32 rotates. By the rotation of the pinion 32, the gearing part 33*b* engaging with the pinion 32 moves upwardly and this makes the sliding element 33 and the slot 33*a* move upwards. According to the ascending movement of the slot 33*a*, the protrusion part 34*b* of the inlet grill 34 rotates under the guidance of the circular arc shaped guiding hole 35*b* so that the inlet grill 34 rotates at a predetermined angle to open the inlet 3.

At the same time, the outlet motor 21 is driven by the control signal of the control part 120 through the outlet motor driving part 133 and rotates the pinion 23. By the rotation of the pinion 23, the rack 25 descends. The outlet door 13 coupled with the rack 25 accordingly descends and the outlet 7 is opened in step 612.

Meanwhile, if the control part determines that the inlet 3 and the outlet 7 are completely opened through the inlet opening/closing sensor 112 and the outlet opening/closing sensor 114, it generates the control signal for stopping the inlet and outlet motor driving parts 131 and 133. By that control signal, both the inlet and outlet motor driving parts 131 and 133 stop.

Thereafter, the control part 120 generates the control signal for driving the air conditioner to drive the condenser motor 47 through the condenser motor driving part 137 and the coolants are circulated by the operation of the condenser motor 47, so that the indoor air intaken through the inlet is heat-exchanged through the heat exchanger 37 in step 614.

After a predetermined time, the indoor fan motor 39 is driven through the indoor fan motor driving part 139 by the control signal. And, the indoor fan 41 rotates in accordance with the indoor fan motor 39 to intake the indoor air through the inlet 3. The air is heat-exchanged in the heat-exchanger and discharged indoors through the outlet 7.

Here, the louver motor 27 is driven by the control signal of the control part 120 according to the wind direction controlled in the operation part 17, and the direction of the air discharged through the outlet 7 is controlled in every direction through the up and down wind blades and the right and left wind blades 11 in step 616.

Meanwhile, if an opening key signal is input from the hole A (or B) of the remote controller 100 through the remote control signal receiving part 172 by the operation of the tester or manager in step 618, the control part 120 generates the control signal for stopping the operations of the condenser motor driving part 137, the indoor fan motor driving part 139 and the louver motor driving part 135 with the inlet 3 and the outlet 7 remaining open.

Therefore, the condenser motor 45 is stopped by the condenser motor driving part 137 with the inlet 3 and the outlet 7 open, to thereby stop the operation of the air conditioner in steps 620 and 622, the indoor fan motor 39 is stopped by the indoor fan motor driving part 139 to thereby stop the indoor fan 41. Accordingly, the louver motor 27 is stopped by the louver motor driving part 135 in step 624.

On the other hand, if the operation stop key signal is input to the control part 120 from the operation part 17 by the user in step 626, the control part 120 closes the inlet 3 and the outlet 7 and generates the control signal for stopping the condenser motor driving part 137, the indoor fan motor driving part 139 and the louver motor driving part 135. Consequently, the inlet 3 and the outlet 7 are closed by the control signal. More particularly, the inlet motor driving part 131 is reversely driven by the control signal to rotate the pinion 32. The gear part 33*b* geared with the pinion 32 moves downwards and the sliding element 33 and the slot 33*a* descend. The protrusion part 34*b* of the inlet grill 34 rotates reversely under the guidance of the circular arc shaped guiding hole 35*b*, so that the inlet grill 34 rotates and closes inlet 3.

At the same time, the outlet motor 21 is reversely driven by the control signal through the outlet motor driving part 133 to reversely rotate the pinion 23, and the rack 25 ascends so that the outlet door 13 coupled with the rack 25 makes an up-motion and closes the outlet 7 in step 628.

By the control signal of the control part 120, the condenser motor 47 is stopped by the condenser motor driving part 137, so that the air conditioner stops. Simultaneously, the indoor fan motor 39 is stopped by the indoor fan motor driving part 139, and the indoor fan stops so that the louver motor 27 is stopped by the louver motor driving part 135 in step steps 622 and 624.

As described above, with this invention, if a tester or a manager operates the opening key formed in the remote controller 100 in the middle of manufacturing procedures or management of the air conditioner, the air conditioner stops with the automatic door, namely, the inlet and the outlet of the air conditioner opened, so that any possibilities of damage of the automatic door occurring in the function test or management of the air conditioner with the automatic door opened are prevented.

It will be apparent to those skilled in the art that various modifications and variations can be made in the method and apparatus of controlling the automatic door of the air conditioner of the present invention without departing from the spirit or scope of the invention. Thus, it is intended that the present invention cover the modifications and variations of this invention provided they come within the scope of the appended claims and their equivalents.

What is claimed is:

1. An air conditioner comprising:

an inlet for receiving room air;

a heat exchanger for changing the temperature of the air received through the inlet;

an outlet for discharging the air back into the room;

a fan for circulating the air sequentially through the inlet, the heat exchanger, and the outlet;

a door for opening/closing one of the inlet and outlet;

power means operably connected to the door for moving the door between open and closed positions;

control means connected to the heat exchanger, the fan, and the power means for automatically actuating the power means to open the door when the heat exchanger and fan are activated and for closing the door when the heat exchanger and fan are deactivated; and manually actuable control by-pass means for maintaining the door open when the heat exchanger and the fan are deactivated.

2. The air conditioner according to claim 1 wherein the control by-pass means is disposed in a remote controller.

3. The air conditioner according to claim 2 wherein the control by-pass means is accessible through a key opening formed in the remote controller.

4. The air conditioner according to claim 3 wherein the key opening is disposed in a compartment having an openable cover.

5. The air conditioner according to claim 4 wherein the compartment comprises a battery compartment.

6. The air conditioner according to claim 1 wherein the control by-pass means is accessible through a key opening.

7. The air conditioner according to claim 1 wherein the door is an outlet door for closing the outlet, and further including an inlet door for opening/closing the inlet, the inlet door operably connected to the power means.

8. A method of controlling an air conditioner which includes an inlet for receiving room air; a heat exchanger for changing the temperature of the air received through the inlet, an outlet for discharging the air back into the room; a fan for circulating the air sequentially through the inlet, the heat exchanger, and the outlet; a door for opening one of the inlet and outlet; power means for moving the door between open and closed positions; and control means for automatically actuating the power means to open the door when the heat exchanger and fan are activated and close the door when the heat exchanger and fan are deactivated, the method comprising the step of manually actuating a control by-pass for maintaining the door open when the heat exchanger and the fan are activated.

* * * * *